US007987843B1

(12) United States Patent
Rodgers

(10) Patent No.: US 7,987,843 B1
(45) Date of Patent: Aug. 2, 2011

(54) BURNER IMPROVEMENT

(75) Inventor: Ian Rodgers, Chattanooga, TN (US)

(73) Assignee: Burner Systems International, Inc., Chattanooga, TN (US)

( * ) Notice: Subject to any disclaimer, the term of this patent is extended or adjusted under 35 U.S.C. 154(b) by 537 days.

(21) Appl. No.: 12/179,832

(22) Filed: Jul. 25, 2008

(51) Int. Cl.

| | |
|---|---|
| ***F24C 3/00*** | (2006.01) |
| ***F24C 3/12*** | (2006.01) |
| ***F23M 3/04*** | (2006.01) |
| ***F23D 14/58*** | (2006.01) |

(52) U.S. Cl. ..... 126/39 E; 126/39 R; 431/89; 431/286; 431/349

(58) Field of Classification Search ..... 126/39 E, 126/39 R; 431/8, 286, 349
See application file for complete search history.

(56) References Cited

U.S. PATENT DOCUMENTS

| | | | | |
|---|---|---|---|---|
| 5,112,218 | A * | 5/1992 | Sigler | 431/266 |
| 5,186,620 | A * | 2/1993 | Hollingshead | 431/354 |
| 5,899,681 | A * | 5/1999 | Maughan | 431/8 |

* cited by examiner

*Primary Examiner* — Kenneth Rinehart
*Assistant Examiner* — William Corboy
(74) *Attorney, Agent, or Firm* — Stephen J. Stark; Miller & Martin PLLC

(57) ABSTRACT

A burner for use with cooking has a multiplicity of slots extending relative to a periphery of a burner head providing primary flame orifices. The slots have slot walls preferably extending upwardly from a slot bottom. A cap tops the burner head. Stops are disposed in the slots so that a smaller cross section is created internal to the slot than at an outlet of the stop to reduce a possibility of flame lifting under high port loading and/or high turn down ratio conditions.

19 Claims, 1 Drawing Sheet

BURNER IMPROVEMENT

FIELD OF THE INVENTION

The present invention relates to a burner and more particularly to an improved burner such as for a cooker configured to provide a superior turn down ratio and reduced flame lifting tendencies.

DESCRIPTION OF RELATED ART

When designing burners for cookers, there are a number of considerations which one skilled in the art may consider. Flame lifting can occur when the speed of the gas exiting a burner exceeds the speed of the flame as it burns. Not only can this be loud and irritating, it may be a safety issue as it could cause a flame to be extinguished while continuing to provide gas from the burner.

Port loading refers to the BTU/in$^2$ relative to the port area.

Turn down ratio refers to the highest rating of the burner (i.e., such as when set to MAX or HI) divided by the lowest rating of the burner (i.e., such when set to LOW).

Many burner designs are available on the market. Presently there is a tendency in burner design to provide higher and higher port loading. Unfortunately, high port loading has been found in some prior art designs to lead to flame lifting, especially in designs with relatively high turn down ratios. An improved burner design is believed to be necessary.

SUMMARY OF THE INVENTION

It is an object of the present invention to provide a burner with an advantageous turn down ratio.

It is another object of the present invention to provide a burner design with the capability of providing a high port loading.

It is another object of the present invention to reduce, if not eliminate flame lifting for a particular burner embodiment.

A burner in accordance with the presently preferred embodiment of the present invention provides a stop or dam located proximate if not in flame slots of a burner. The stop is preferably utilized to provide a reduced cross sectional area for which a flow of gas proceeds through at the stop and then which is then followed by a relatively larger cross-sectional area in the slot after the stop so that a relative decrease in pressure can occur after the stop and a slow down in gas flow. By utilizing a stop, a relative step decrease in pressure can occur which has been found to provide advantageous flame characteristics as described herein.

BRIEF DESCRIPTION OF THE DRAWINGS

The particular features and advantages of the invention as well as other objects will become apparent from the following description taken in connection with the accompanying drawings in which:

FIG. 3 is a detail view of a portion of FIG. 1;

DETAILED DESCRIPTION OF THE PREFERRED EMBODIMENT

Figure 1:
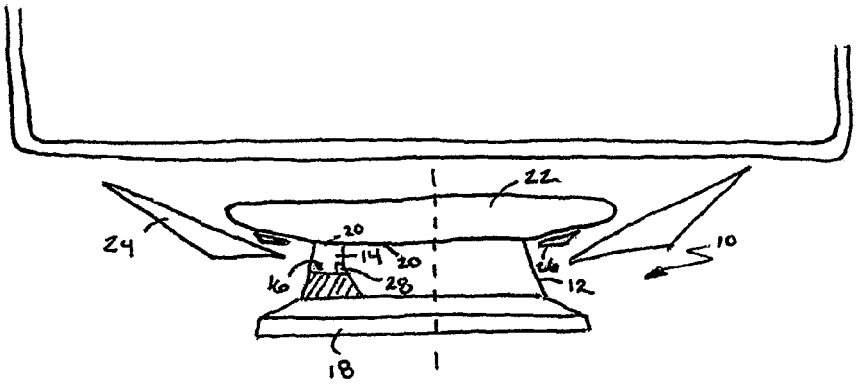
FIG. 1 shows schematically a burner head designed in accordance with the presently preferred embodiment of the present invention.

A burner 10 is illustrated having a peripheral side wall 12 of a burner head which is illustrated as being slightly frustoconical, but could be more conical, substantially vertical or vertical in other embodiments. Slots 14 provide a plurality primary flame orifice which extends transversely to the side wall 12. Although only eight are illustrated in the drawing for purposes of drawing clarity, it will be understood by those of ordinary skill in the art that any number of slots, which are typically more than sixteen, such as twenty two, etc. could be utilized. Peripheral side wall 12 is illustrated having a circular cross section, but other cross sections would be able to embody the technology described herein, whether they be "star" shaped, oval, or any other shape.

Slots 14 have slot bottoms 16. Slot bottoms have been traditionally horizontal in nature, although co-owned U.S. Pat. No. 6,679,699 shows an upward angle of inclination in a range of 20 to 30 degrees. The slots 14 and slot bottoms are typically formed, or machined, or otherwise provided in a base 18, but in other embodiments the slots 14 and/or slot bottoms 16 could be provided in other and/or alternative structures. It has been found convenient to form the slots 14 when casting the base 18, but various other manufacturing techniques are known in the art.

Figure 2:
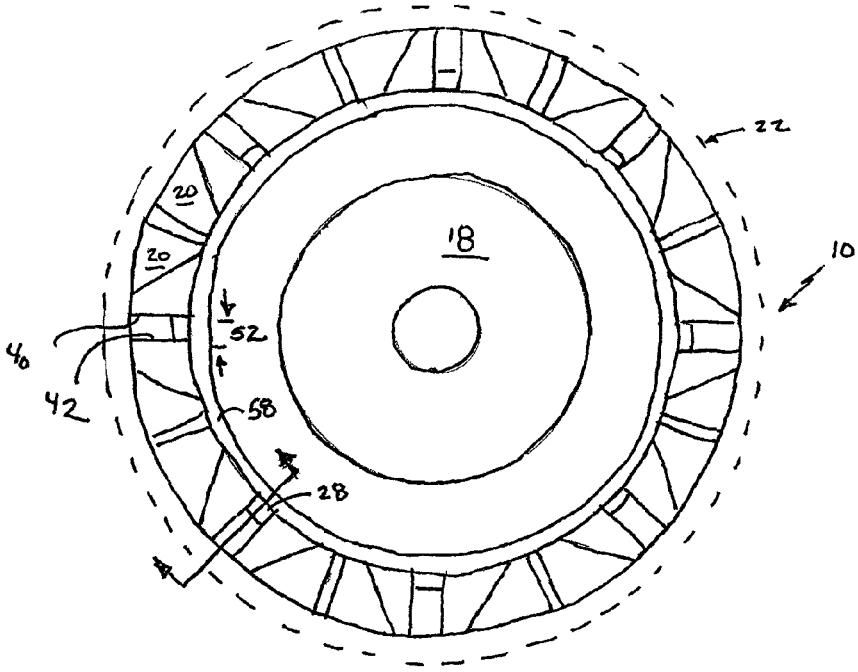
FIG. 2 shows a schematic view from the top of the embodiment illustrated in FIG. 1 with the burner cap shown in phantom.

Secondary flow passages 20 are also normally provided toward an upper portion of the side walls 12. The secondary flow passages 20 allow a simmer flame 26 to be provided normally just below a cap 22. Secondary flow passages 20 are illustrated in FIG. 2. One skilled in the art will understand that they usually are disposed about at least a substantial portion of the periphery of the side wall 12. Other embodiments could provide alternative and/or additional placement locations. Some burner configurations may provide other flow passages, and it is possible that slots 14 are provided without secondary flow passages 20 in still other embodiments.

In the illustrated embodiment, the cap 22 forms a top relative to the slots 14 as well as the secondary flow passages 20 to assist in defining the primary flame orifices and simmer flame orifices. In other embodiments this may not necessarily be the situation for one or both of the slot(s) 14 and/or secondary flow passage(s) 20. Simmer flames 26 are illustrated extending away from the simmer flame orifices in FIG. 1.

Figures 3A, 3B, 3C, 3D:
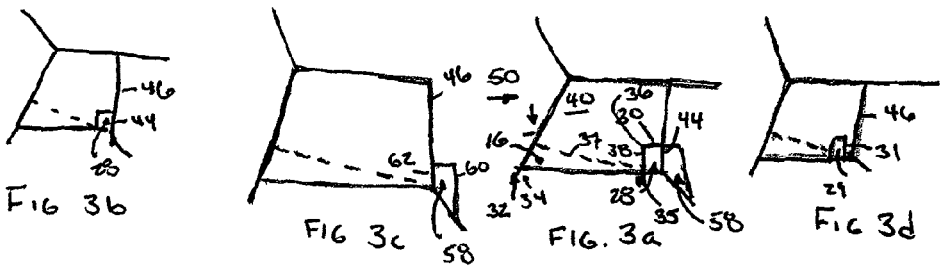
FIG. 3*a* is a detailed view of a portion of FIG. 1 and the cross section A-A of FIG. 2.
FIG. 3*b* is alternately preferred embodiment showing somewhat similar structure to FIG. 3*a;*
FIG. 3*c* is an alternately preferred embodiment showing somewhat similar structure as 3*a*.
FIG. 3*d* is an alternately preferred embodiment showing somewhat similar structure as FIG. 3*a*.

First stop 28 is illustrated in the primary flame orifice in FIGS. 2 and 3*a*. Stop 28 has an upper surface 30 which extends an elevation 32 above slot bottom 16, preferably as measured at outlet point 34. In alternative embodiments the slot bottom 16 may be sloped as shown by numeral 37. In this case, the elevation 32 would be measured relative to the rear wall 38 where it contacts at floor point 35 with the slot bottom 37 as illustrated in dotted lines.

In the preferred embodiment, upper surface terminates rather sharply at edge 36 and proceeds downwardly toward slot bottom 16 to provide a relatively rapid increase of flame orifice cross section area from the stop 28 outwardly toward outlet point 34. This increase in cross section area necessitates a decrease in pressure as the fuel mixture exits the primary flame orifice producing flame 24 as shown in FIG. 1. In the preferred embodiment illustrated, stop 28 has a rear or back wall 38 that is at least substantially, if not completely, vertical. Other embodiments may have an angled wall 38, or may be otherwise configured to provide a desired pressure drop within the slot 14 under certain conditions.

It is preferable that the cross sectional area of the slot 14 at the stop 28 be roughly in a range of about 50%-98% of the cross sectional area of the slot 14 at the outlet point 34. More particularly, it is preferable to be in a range of about 75% to about 95%. Depending on the particular embodiment of the burner 10, different ratios could be established to provide desired design characteristics.

Although first stop 28 is illustrated extending from the base 18 in the preferred embodiment, principally because it is easy to cast it as part of the base 18, it could be formed into one or more slot walls 40,42, the cap 22 (such as a bottom surface or otherwise), or other structure. The stop 28 could also be inserted or otherwise provided apart or in concert with the manufacturing of the slot 14 and/or cap 22.

The stop 28 of the preferred embodiment has an inner face 44 which may be continuous and/or adjacent with inner wall of base 18, or not, in other embodiments. A second, or alternative, stop 58 may be used in some embodiments. In fact, an inner face 60 is illustrated spaced internal of slot entry 46. A stop front wall 62 could terminate at the inner face 60 or even internally or externally disposed relative to the slot 14 and inner wall or face 60. A second stop 58 may be used with, or alternatively to first stop 28, in some embodiments. The upper most point and/or the upper surface 30 of the stop 28 is preferably located at least partially within the slot 14 so that a pressure drop due to an increase in cross sectional area of the slot 14 preferably occurs within the slot 14 from the slot inlet 48 toward the slot outlet 50. This would create a first gas flow rate at the stop 28 or 58 which exceeds a second gas flow rate downstream of the stop 28 or 58 within the slot 14. Of course when only using second stop 58 as illustrated, the pressure may drop begin prior to or at the entry to the slot 14. In various embodiments only one of first or second stop 28, 58 be utilized in the preferred embodiment, but other embodiments could use both.

The first or second stop 28, 58 could also be described as a dam and/or an obstruction. It need not have planar surfaces as shown. They could be curved and/or irregular in addition or instead of the illustrated embodiment. While a somewhat rectangular cross section is illustrated in FIGS. 1 and 3 for the stop 28, it could take a variety of cross sections and need not be consistent across its width 52 as shown in FIG. 2. Side walls 40,42 as well as slot bottom 16 and cap bottom 54 also need not necessarily be substantially planar and/or planar as illustrated in other embodiments. The stops 28 or 58 are illustrated closer to a slot inlet than slot outlet 50.

FIG. 3*d* shows an alternatively preferred embodiment of first stop 29 having an inner face 31 located downstream of the slot entry 46 as could occur in some alternatively preferred embodiments.

The preferred embodiment illustrated has been found to provide a good turn down ratio of about 20:1 (i.e., from Max to Low). Furthermore, flame lifting tendencies are decreased, if not eliminated under the design considerations of the preferred embodiment. Finally, at least relatively high port loading can still be achieved.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A burner comprising:

a cap; and a burner head which is bounded by a peripheral side wall, said burner head being topped by the cap, said side wall having a multiplicity of slots distributed peripherally and at least partially assisting in forming flame orifices, said slots having an inlet and an outlet and at least one stop at least proximate to at least one slot, wherein a first gas flow rate at the stop exceeds a second gas flow rate downstream of the stop within the slot; and the stop is located at least partially internal of the slot in the burner head and a cross sectional area at the stop is in a range of about 50% to 98% of a cross sectional area of a portion of the slot downstream of the slot.

2. The burner of claim 1 wherein said slots have a slot bottom and slot walls and said stop is connected to at least one of the slot bottom and slot walls.

3. The burner of claim 2 wherein the slot bottom is at least substantially planar and the stop extends toward the cap from the slot bottom closer to the inlet than the outlet of the slot.

4. The burner of claim 1 wherein the stop has at least one uppermost elevation which is located a distance above the outlet at the slot bottom.

5. The burner of claim 4 wherein the stop has an upper surface having the at least one uppermost elevation disposed thereon.

6. The burner of claim 5 wherein the upper surface of the stop ends at an edge and extends downwardly to at least one of the slot bottom and the base.

7. The burner of claim 6 wherein the stop further comprises a rear wall that is at least substantially vertical.

8. The burner of claim 7 wherein the rear wall connects the edge to the slot bottom.

9. The burner of claim 1 wherein the cap assists in defining at least one flame orifice.

10. The burner of claim 1 further comprising a base and the burner head is atop the base.

11. The burner of claim 1 wherein the slots further comprise slot walls extending upwardly from a slot bottom with the slot walls having at least one internal point and the stop having an internal point and the internal points of at least one of the slot walls and the stop coinciding.

12. The burner of claim 11 wherein the stop has an internal wall and wherein the internal wall of the stop is continuous with the slot wall.

13. The burner of claim 1 wherein the stop extends at least a width of the slot.

14. The burner of claim 13 wherein the slot has slot walls extending upwardly relative to a slot bottom and the width extends intermediate the slot walls.

15. A burner for a cooker comprising:

a cap; and a burner head which is bounded by a peripheral side wall, said burner head being topped by the cap, said side wall having a plurality of slots distributed peripherally and at least partially assisting in forming flame orifices, said slots having an inlet and an outlet and a stop positioned at least proximately relative to the slot, wherein a first gas flow rate at the stop is greater than a second gas flow rate downstream of the stop within the slot and the stop is located closer to the inlet than the outlet; and and a cross sectional area at the stop is in a range of about 50% to 98% of a cross sectional area of a portion of the slot downstream of the slot.

16. The burner of claim 15 wherein said slots have a slot bottom and slot walls and said stop is connected to at least one of the slot bottom and slot walls.

17. The burner of claim 16 wherein the slot bottom is at least substantially planar and the stop extends toward the cap from at least one of the slot bottom and base.

18. The burner of claim 17 wherein the stop has at least one uppermost elevation which is located a distance above the outlet at the slot bottom.

19. The burner of claim 18 wherein the stop has a planer surface which meets a rear surface at an edge and the rear surface is substantially perpendicular to the upper surface of the stop.

* * * * *